US006691330B2

(12) United States Patent
Baker

(10) Patent No.: US 6,691,330 B2
(45) Date of Patent: Feb. 17, 2004

(54) ADJUSTABLE TOILET SEAT HANDLE

(76) Inventor: Sondra Baker, 2360 Sunset Plaza Dr., West Hollywood, CA (US) 90069

( * ) Notice: Subject to any disclaimer, the term of this patent is extended or adjusted under 35 U.S.C. 154(b) by 0 days.

(21) Appl. No.: 10/352,539

(22) Filed: Jan. 28, 2003

(65) Prior Publication Data

US 2003/0140405 A1 Jul. 31, 2003

Related U.S. Application Data

(60) Provisional application No. 60/352,409, filed on Jan. 28, 2002.

(51) Int. Cl.[7] ..... A47K 13/10
(52) U.S. Cl. ..... 4/246.1; 16/905
(58) Field of Search ..... 4/246.1, 577.1; 16/422, 905; 269/171.5

(56) References Cited

U.S. PATENT DOCUMENTS 3,191,193 A * 6/1965 Bogenberger ..... 4/246.1
5,027,472 A * 7/1991 Goodman ..... 16/422

* cited by examiner

*Primary Examiner*—Charles E. Phillips
(74) *Attorney, Agent, or Firm*—Marvin H. Kleinberg; Marshall A. Kleinberg; Kleinberg & Lerner, LLP

(57) ABSTRACT

A grasping handle for a toilet seat includes a base unit having an inner lip and a slidable handle unit having an outer lip. The handle unit telescopes into the base unit. In a preferred embodiment, the handle unit includes a pair of toothed prongs which engage matching teeth on the interior of the base unit. The lips grasp the inner and outer perimeters of the toilet seat between them and the spacing is held by the engagement of the teeth. A release mechanism includes plungers which bias the prongs away from the interior walls, disengaging the teeth. In an alternative embodiment, the prongs include a cross member which carries a torsion spring with arms that engage the base unit interior walls. The torsion spring biases the handle into a fully telescoped condition and thereby exerts a spring force to keep a toilet seat grasped between the inner and outer lips.

11 Claims, 3 Drawing Sheets

ADJUSTABLE TOILET SEAT HANDLE

This is a continuation-in-part of a Provisional Application filed on Jan. 28, 2002, having U.S. Application Ser. No. 60/352,409

BACKGROUND

1. Field of the Invention

The present invention relates generally to the field of toilet seat attachments and more specifically to a device to facilitate the raising or lowering of a toilet seat without the need for physical contact with the seat.

2. Prior Art

A commonly encountered problem in the use of the conventional toilet, and especially in the case of a toilet that is used or maintained by strangers, is that the user must touch the seat in order to raise and lower it onto the toilet bowl. Toilet seats, and particularly the undersides thereof, due to their proximity to the bowl, tend to be unsanitary and few people, if any, disinfect them after use. This concern is particularly acute as regards public toilets.

Toilet seat handles are well known in prior art and a number of such devices have been created. However, problems exist with the prior art devices in that such devices have been bulky, complicated or expensive preventing widespread acceptance in the user community. Some devices failed to allow for easy replacement or adjustment because they were rigidly affixed to the seat. Other devices failed to stay affixed over time because they were glued on. Still other devices were overly complicated, requiring foot pedals, automatic lifters and the like. Other devices were simply not aesthetically pleasing.

A more complete discussion of the shortcomings of prior art devices is found in U.S. Pat. No. 5,027,472 issued to Goodman on Jul. 2, 1991. Goodman disclosed a handle of two parts joined together by a long bolt. The bolt passes through one part of the handle, threads into the second part, and tightens until the two parts firmly clamp onto the toilet seat. The Goodman device has not gained popular acceptance.

Therefore, there is still a need for a toilet seat handle that enables the user to raise or lower the toilet seat without having to touch the deat. Moreover, there remains a need for a toilet handle that is easy to grasp and which will stay securely attached. Finally, such a device should quickly and easily attach to the seat.

The present invention, described in detail below, overcomes the disadvantages of the prior art toilet seat handle arrangements, and also affords advantages not provided by the toilet seat handle arrangements heretofore disclosed. Thus, it would be a useful advance in the art to provide an inexpensive and quickly re-configurable toilet seat handle that accommodates a large range of seat widths and configurations.

BRIEF SUMMARY OF THE INVENTION

According to the present invention, an improved toilet seat handle is provided that allows a toilet seat to be lowered or raised without requiring manual contact with the seat. The invention includes a removable, adjustable toilet seat handle that fits a variety of toilet seats and allows the user to remove the device for cleaning.

The handle provides the user with (1) a sanitary method of lifting and lowering the toilet seat, (2) a single device which can be used on multiple seats of varying size during its lifetime, and (3) a device which can be cleaned easily and more effectively than any other devices which are permanently affixed to the seat.

In the preferred embodiment, the invention is a device of moderate size and is roughly rectangular. The device includes a base element with a first, inner lip, and an extended handle portion that projects beyond the perimeter of the seat and has a second, outer lip. The handle portion has two serrated arms that are adapted to be inserted into the base element. The base element interior contains serrations matching those of the arms.

When installed, the top of the base element is directly underneath and affixed to the toilet seat. The inner lip of the base rests against the inner edge of the toilet seat. The handle portion is inserted into the base with the outer lip resting against the outer edge of the seat. The arms are slightly divergent. The depth of the handle's insertion into the base is then adjusted to accommodate the widths of various toilet seats being mass manufactured.

The lips may be made of material having some limited resiliency so that they can be slightly deformed to assure that the seat is tightly engaged. When installed in the preferred embodiment, the device may be positioned in a front quadrant of the seat. However, the position of the device with respect to the toilet seat is not a limiting factor of the invention.

In an alternative embodiment, the handle works like an adjustable, sliding "clamp" and is a self-contained unit, which does not require screws, adhesive tape or any other method of affixing. In this embodiment of the invention, a user places an outer lip of the handle flush against the outer curve of the toilet seat (roughly in the front quadrant), and then expands the bottom of the clamp (working against a spring action) allowing an inner lip to grab the underneath portion of the seat to snap onto the inner ring of the toilet seat flush against the inner curve.

Once the handle is securely attached to seat, the user simply takes hold of the protruding handle element in order to lift the seat up and down. The device is removed by expanding the clamp. For the more fastidious, a disposable plastic sheath can be provided for one-time use with either embodiment.

Accordingly, it is an object of the present invention to provide an improved toilet handle arrangement.

It is also an object of the present invention to provide a toilet seat handle that can be easily configured to accommodate a wide variety of shapes and sizes of toilet seats.

It is yet another object of the invention to provide a toilet seat handle assembly that may be readily installed and removed without tools and with a minimum of moving parts.

It is a further object of the present invention to provide a toilet seat handle at a much lower cost than prior inventions.

It is a further object of the present invention to provide a toilet seat handle that is easily installed, securely affixed to the toilet seat and easily replaceable.

Further features and advantages of the present invention will be appreciated by reviewing the following drawings and detailed description of the invention.

BRIEF DESCRIPTION OF THE DRAWINGS

For a further understanding of the objects and advantages of the present invention, reference should be had to the following detailed description, taken in conjunction with the accompanying drawings, in which like parts are given like reference numbers.

DETAILED DESCRIPTION OF THE INVENTION

For the purposes of explanation, specific component arrangements and constructions and other details in the following description are set forth to provide a more thorough understanding of the present invention. It will be apparent to those skilled in the art, however, that the present invention may be practiced without these specific details. In some instances, well known manufacturing methods and structures have not been described in detail so as not to obscure the present invention unnecessarily.

Figure 1:
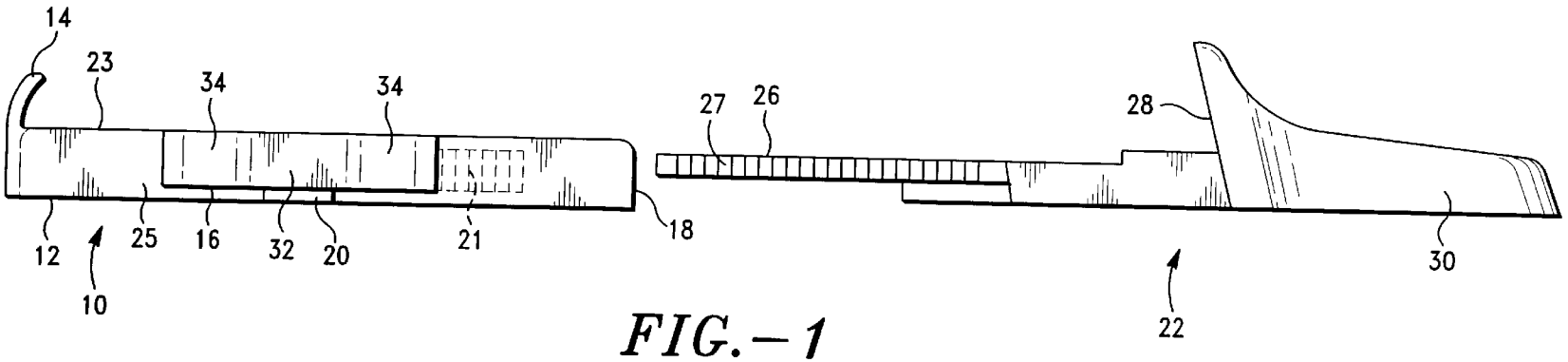
FIG. 1 is a side elevation view of a toilet seat handle according to a preferred embodiment of the present invention.
Figure 2:
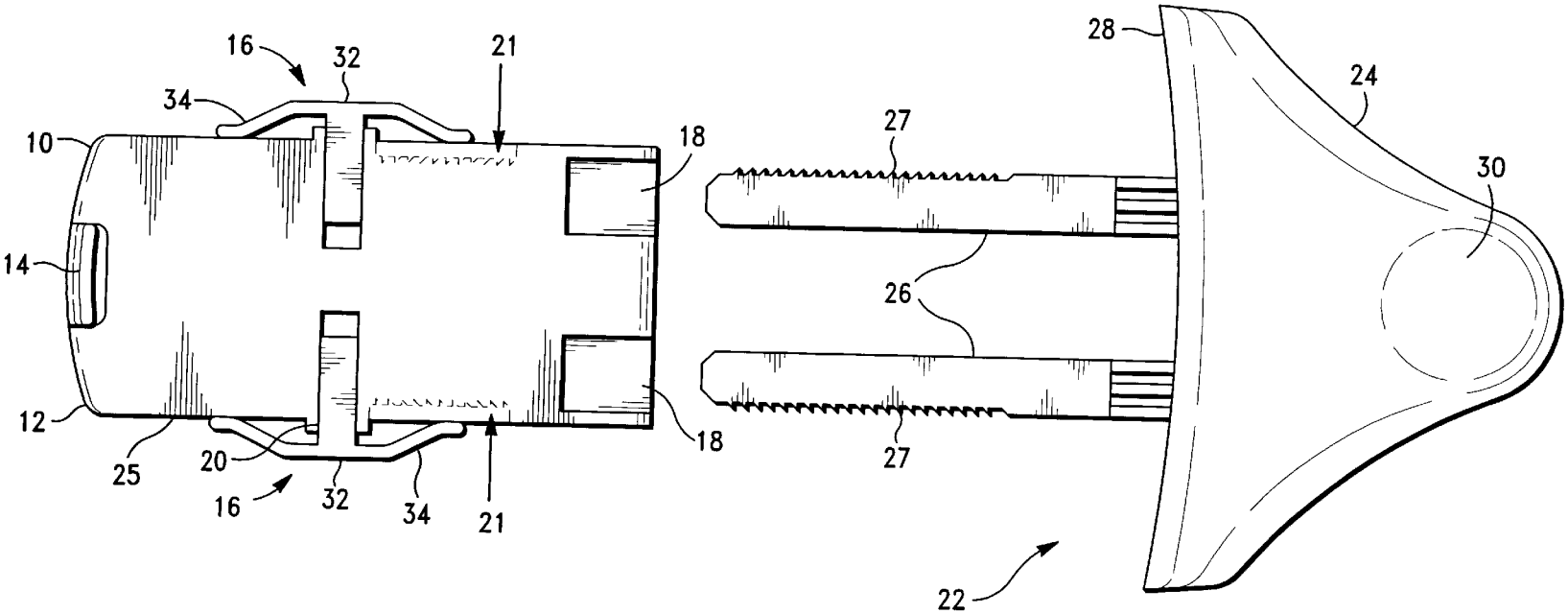
FIG. 2 is a top elevation view of the handle of FIG. 1.

Referring first to FIGS. 1 and 2, an adjustable toilet seat handle 10 is shown. In the preferred embodiment, the handle 10 has a base 12, an inner lip component 14 at one end of the base, plungers 16 on each side of the base, and an aperture 18 at the end of the base opposite the lip 14. A pair of openings 20 are located on either side of the base 12 into which a pair of plungers 16 are respectively fitted. The interior walls of the base 12 have serrations or teeth 21.

The handle element portion 22 has a handle 24, a pair of legs or prongs 26 and an outer lip 28. The outer edge of each of the two prongs 22 is serrated to include teeth 27 which match the teeth on the interior walls of the base 12. The outer lip 28 is positioned on the handle element portion 22 at its edge closest to the prongs 26 and is roughly perpendicular to the planar surface of both the handle 24 and prongs 26. The prongs 24 diverge slightly and are sufficiently flexible that they can be urged to a parallel or even converging relationship. The handle element portion 22 has, at its outer end, a finger grip 30 which can be grasped to raise or lower the toilet seat.

The two prongs 26 of the handle element portion 22 are inserted into the aperture 18 at the end of the base 12. The prongs 26 slide into the base 12, past the base unit teeth 21. The plungers 16 have an opening through which the prongs 26 can pass, holding the plungers 16 in place. The plungers 16 may include a cap 32 with extending arms 34 that are flexible and resilient. Depressing the plungers 16 displaces the arms 34 which are then biased to return to their original configuration.

Normally, insertion of the prongs 26 into base 12 causes the teeth 27 on the prongs 28 to engage the teeth 21 on the interior wall. When so engaged, rearward movement of the handle element portion 22 is prevented unless the plungers 16 are depressed to disengage the teeth 21, 27. This temporarily pushes the prongs 28 towards the center of the base 12 and away from the teeth 21.

If the handle 10 is not secure on the seat, the handle element portion 22 can be pushed further into the recess of the base 12 and the teeth will slip until the desired position is reached. Because the lips 14, 28 are somewhat resilient, if the engagement is too tight, the plungers 16 can be depressed to release the teeth 21, 27 and the prongs 28 will be released.

In the particular embodiment illustrated in the drawings, the outer and inner lips 14, 28 are a pair of opposing, concave arcs that surround and grasp the inner perimeter and outer perimeter of the toilet seat, respectively. In this manner, the base unit 12 and handle element portion 22 cooperate to provide a variable length seat handle 10 that can accommodate the width of virtually all toilet seats currently on the market.

when in use, the invention 10 attaches to the bottom surface of a toilet seat (not shown) with the top surface of the seat handle 10 adjacent to and cooperating with the bottom surface of the toilet seat. The inner lip 14 cooperates with the inner perimeter of the toilet seat. The outer lip 28 cooperates with the outer perimeter of the toilet seat. By sliding the handle element 22 into the base 12 until the base unit lip 14 and the base extension lip 28 are firmly in contact with the inner and outer perimeters of the toilet seat, the device 10 is firmly coupled to the toilet seat and the engaged teeth hold that configuration.

Figure 3:
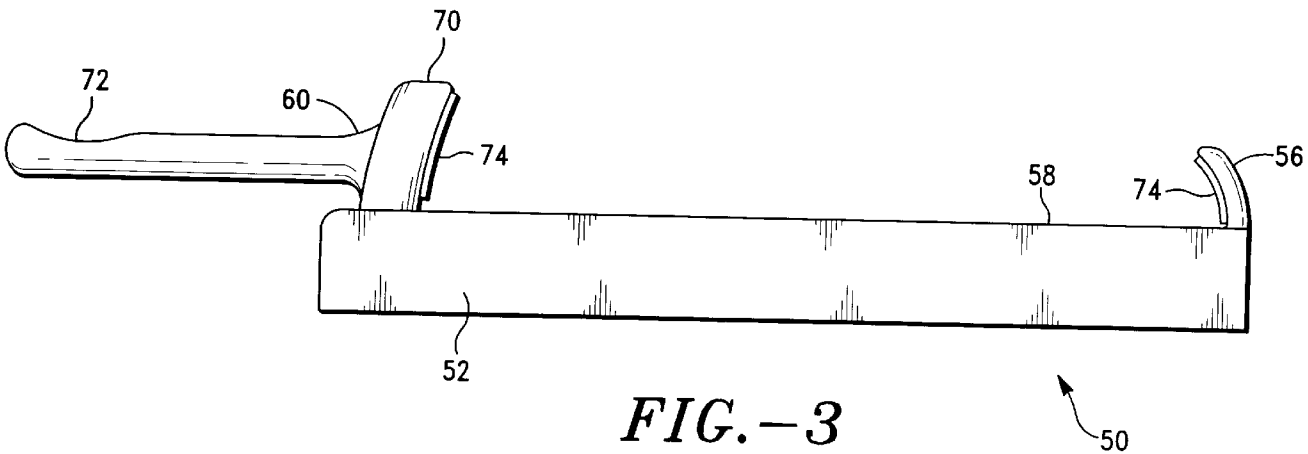
FIG. 3 is a side view of a toilet seat handle according to an alternative embodiment of the invention.
Figure 4:
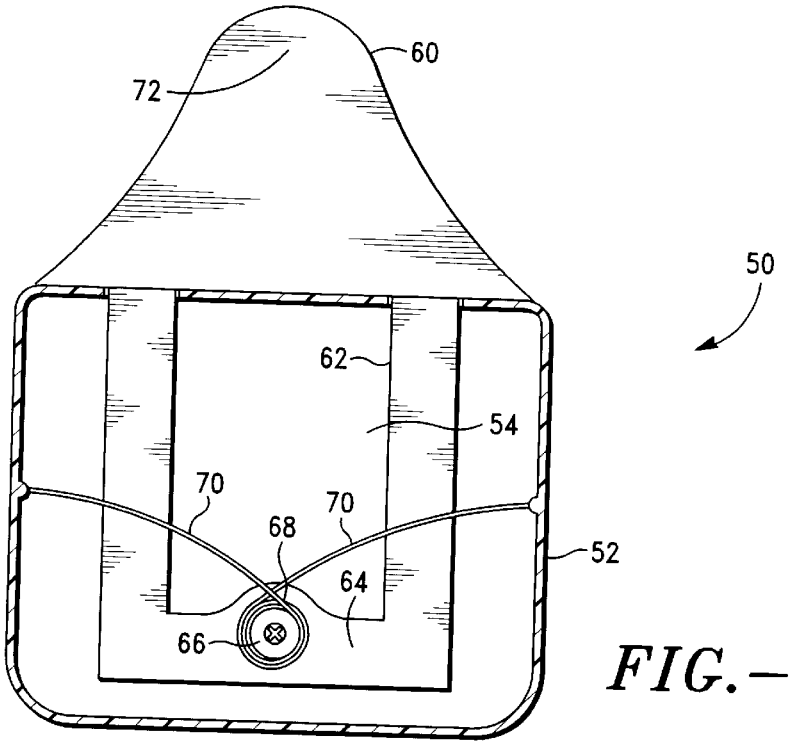
FIG. 4 is a top section view of the toilet seat handle of FIG. 3 fully telescoped.
Figure 5:
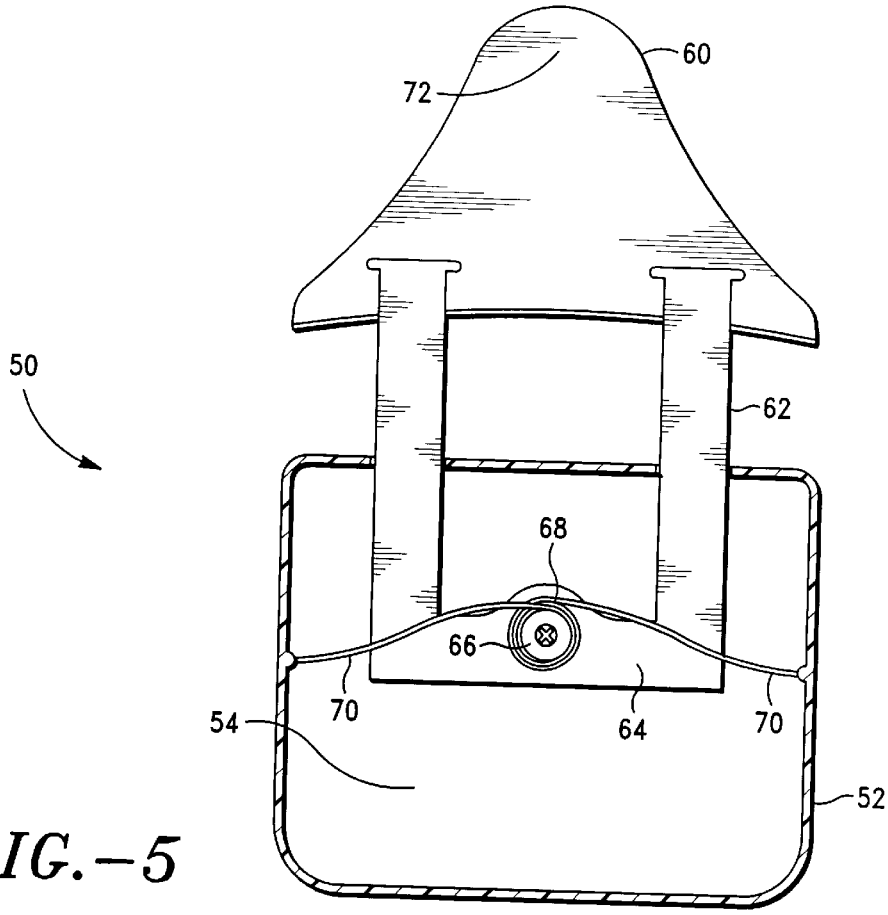
FIG. 5 is a top section view of the toilet seat handle of FIG. 4 extended.

Other methods of spring loading may be used with equal effectiveness as shown by the alternative embodiment of FIGS. 3, 4 and 5. Rather than by using plungers 16 against diverging prongs 26, an alternative seat handle 50 has a base portion 52 with a hollow interior 54. An inner lip 56 extends above the base unit 52 upper surface 58.

A handle unit 60 includes a pair of arms 62 that are joined by a cross piece 64. A post 66 has a torsion spring 68 mounted thereon with extending spring arms 70. When initially assembled, the arms 70 are anchored in the interior walls of the base unit 52 to provide a substantial spring bias urging the handle portion 62 to remain within the base unit 52. The outer lip 70 rises from the handle portion 60 adjacent a finger grip 72. Resilient cushioning strips 74 could be affixed to the contact surfaces of the inner and outer lips 56, 70.

In use, the alternative embodiment seat handle 50 is placed adjacent the underside of a toilet seat. While holding the base unit 52 firmly, the finger grip 72 of the handle portion 60 is extended from the base unit 52 against the pull of the spring arms 70. When the inner and outer lips 56, 70 span the width of the toilet seat ring, the seat handle 50 can be placed in contact with the seat underside and the finger grip 72 is released. The spring arms 70 then hold the lips in place against the edges of the toilet seat.

The description of the present invention has been made with respect to specific arrangements and constructions of a toilet seat handle. It will be apparent to those skilled in the art that the foregoing description is for illustrative purposes only, and that various changes and modifications can be made to the present invention without departing from the overall spirit and scope of the present invention. The full extent of the present invention is defined and limited only by the following claims.

What is claimed as new is:

1. A toilet seat handle, comprising:

a base unit having upper and lower surfaces and side walls and a substantially hollow interior;

a first lip element substantially perpendicular to said base unit arising from said base unit upper surface;

a handle element unit including a grasping handle portion;

a second lip element substantially perpendicular to said handle element arising from said handle element unit;

a pair of prong elements extending from said handle portion at the end opposite the grasping handle portion adapted to be inserted into said base unit interior; and means for retaining said prong elements in said base unit interior;

whereby a toilet seat handle can be retained between said first and second lip elements when said prong elements are retained in said base unit.

2. The device of claim 1 wherein said prongs have teeth along the edges adjacent said base unit interior and said base unit interior has matching teeth along the interior walls, whereby said teeth can engage to restrict movement of said prongs relative to said base unit.

3. The device of claim 1, wherein said grasping handle portion is adapted to receive a disposable sanitary covering.

4. The device of claim 1 wherein said prongs are resilient and diverge slightly from parallel, biasing the teeth on said prong into engagement with the teeth on said base interior wall.

5. The device of claim 2 further including a pair of plunger elements adapted to be inserted into said base interior through said base side walls and wherein said plungers are apertured to receive said prong elements whereby movement of said plunger elements into said base interior acts upon said prong elements to bias them away from said base interior walls, disengaging said teeth and permitting motion of said prong elements relative to said base unit.

6. The device of claim 5 wherein said plungers include a cap having resilient arms adapted to rest on said base unit sides and for providing a restoring force to said plungers when said plungers are depressed to engage said prong elements.

7. The device of claim 5 wherein said plungers include a cap having resilient arms adapted to rest on said base unit sides wherein said arms provide a restoring force to said plungers when said plungers are depressed to engage said prong elements.

8. The device of claim 1 wherein said prong elements are joined at their outer ends by a cross member having a central post and further including torsion spring means mounted on said central post, said torsion spring means including spring arms engaged by said base unit interior walls whereby said torsion spring means bias said handle element into full insertion into said base means and resist handle motion tending to withdraw said prong elements from said base interior.

9. A toilet seat handle, comprising a base unit having a sides and a substantially hollow interior;

a plurality of teeth arranged along said base interior walls;

a first lip component affixed perpendicularly to said top of said base unit at a first end;

a handle unit having extending prong means;

a second lip component affixed perpendicularly to said handle unit;

a second plurality of teeth arranged along the outer edges of said prong means, said prong means adapted to be received in said base unit interior enabling said prong means teeth to engage said base unit teeth;

plunger means insertable into the side walls of said base unit and apertured to receive said prong means, aid plunger means extending beyond said base unit side walls;

whereby said toilet seat handle is able to accommodate seats of various widths when said handle element is inserted into said base element and said lip elements converge on the inner and outer edges of a toilet seat, allowing a user to raise or lower the toilet seat using said handle element without direct contact with the toilet seat.

10. The invention of claim 9 wherein said prong means diverge slightly assuring engagement of said prong means teeth with said base unit interior teeth.

11. The invention of claim 10 wherein said plunger means act upon said prong means for disengaging said prong means teeth from said base unit interior teeth, permitting movement of said handle element in and out of said base interior, thereby varying the spacing between said lip elements to accommodate varying toilet seat widths.

* * * * *